US005078086A

United States Patent [19]

Kopko et al.

[11] Patent Number: 5,078,086

[45] Date of Patent: Jan. 7, 1992

[54] DEVELOPER UNIT HAVING AN INDEXABLE MAGNET

[75] Inventors: John J. Kopko, Macedon; Joseph A. Seyfried, Webster, both of N.Y.

[73] Assignee: Xerox Corporation, Stamford, Conn.

[21] Appl. No.: 196,573

[22] Filed: May 20, 1988

[51] Int. Cl.[5] ..... G03G 15/09

[52] U.S. Cl. ..... 118/657; 355/251; 355/253; 355/326

[58] Field of Search ..... 355/245, 251, 253, 259, 355/326; 118/657, 658

[56] References Cited

U.S. PATENT DOCUMENTS

| | | | |
|---|---|---|---|
| 3,709,713 | 1/1973 | Turner | 117/17.5 |
| 3,724,943 | 4/1973 | Draugelis et al. | 355/251 X |
| 3,795,917 | 3/1974 | Yamaji et al. | 355/326 |
| 4,385,829 | 5/1983 | Nakahata et al. | 355/253 |
| 4,422,405 | 12/1983 | Kasahara et al. | 118/658 |
| 4,461,562 | 7/1984 | Goldfish | 355/3 DD |
| 4,591,261 | 5/1986 | Saruwatari et al. | 355/4 |
| 4,601,259 | 7/1986 | Yamashita | 355/253 X |
| 4,746,952 | 5/1988 | Kusuda et al. | 355/253 |

*Primary Examiner*—Fred L. Braun

*Attorney, Agent, or Firm*—H. Fleischer; J. E. Beck; R. Zibelli

[57] ABSTRACT

An apparatus in which a latent image is developed with magnetic developer material. A rotating applicator roll transports the developer material. A magnet is mounted rotatably interiorly of the applicator roll and generates a magnetic flux field which attracts the developer material to a portion of the surface of the applicator roll. The magnet rotates under the influence of the magnetic flux field force applied thereon. When the apparatus is developing the latent image, the magnet is prevented from rotating in a first position wherein the magnetic flux field attracts the developer material to the portion of the applicator roll adjacent the latent image. Conversely, when the apparatus is not developing the latent image, the magnet is prevented from rotating in a second position wherein the magnetic flux field attracts the developer material to the portion of the applicator roll spaced from the latent image. An apparatus of this type is particularly useful in color electrophotographic printing wherein successive electrostatic latent images are developed with different color developer materials. In a color printing machine, one color developer material is being developed on the latent image with the other color developer materials being spaced from the latent image to prevent intermingling of colors.

12 Claims, 2 Drawing Sheets

DEVELOPER UNIT HAVING AN INDEXABLE MAGNET

This invention relates generally to an electrophotographic printing machine, and more particularly concerns an improved development apparatus for use therein.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing marking particles into contact therewith. This forms a powder image on the photoconductive member which is subsequently transferred to a copy sheet. The copy sheet is heated to permanently affix the marking particles thereto in image configuration.

Various types of development systems have hereinbefore been employed. These systems utilize two component developer mixes or single component developer materials. Typical two component developer mixes employed are well known in the art, and generally comprise dyed or colored thermoplastic powders, known in the art as toner particles, which are mixed with coarser carrier granules, such as ferromagnetic granules. The toner particles and carrier granules are selected such that the toner particles acquire the appropriate charge relative to the electrostatic latent image recorded on the photoconductive surface. When the developer mix is brought into contact with the charged photoconductive surface, the greater attractive force of the electrostatic latent image recorded thereon causes the toner particles to transfer from the carrier granules and adhere to the electrostatic latent image.

Heretofore, development systems have employed rotary impellers, fur brushes, bucket conveyors and magnetic brush systems to achieve the requisite uniformity in toner deposition. The magnetic brush system achieves a high degree of uniform deposition and, therefore, numerous electrophotographic printing machines utilize this type of development system. Usually, a magnetic brush system includes a developer roller having a directional magnetic flux field to bring the magnetizable developer mix into contact with the charged photoconductive surface. Multicolor electrophotographic printing involves the utilization of various processing components adapted to produce a series of electrostatic latent images corresponding to a particular color in the original document. In a system of this type, successive partial color images are developed. Each partial color image is developed with toner particles corresponding in color to the partial color image utilized to form the respective electrostatic latent image on the photoconductive surface.

Generally, the developer roller of the magnetic brush development system is mounted fixedly relative to the photoconductive surface. This restricts the quality of multicolor copies. A multicolor development system utilizes a plurality of developer rollers, each being adapted to furnish the appropriately colored toner particles to the photoconductive surface. Developer rollers which are fixedly mounted are positioned closely adjacent to the photoconductive surface. In this way, the developer roller having the developer mix adhering thereto deposits toner particles on the photoconductive surface. However, a developer mix having toner particles of one color contacts the toner powder image of another color resulting in intermingling of colors and mechanical scraping of the toner powder image. This results in the toner powder image being wrongly colored and the multicolor copy produced thereby lacking the appropriate color balance, i.e. the color does not correspond to the color in the original document being copied. To overcome this problem, the developer housings have been mounted movably in the printing machine. Thus, one developer housing is positioned in the operative location with the remaining developer housings being spaced from the photoconductive surface. In this way, successive developer housings are located adjacent the photoconductive surface to develop the electrostatic latent image while the other developer housings remain spaced therein in the inoperative position. Electrophotographic printing machines utilizing the foregoing type of development systems are the Model Numbers 6500 and 1005 made by the Xerox Corporation. A system of this type is rather complex and requires that each developer housing be mounted movably. This utilizes additional hardware and increases the cost of the development system. Preferably, it is desirable to maintain the developer housing fixed with respect to the photoconductive surface and to prevent different color developer material from being attracted to the same electrostatic latent image. Various types of techniques have been used to develop latent images in electrophotographic printing machines. The following disclosures appear to be relevant:

U.S. Pat. No. 3,709,713 Patentee: Turner Issued: Jan. 9, 1973

U.S. Pat. No. 4,422,405 Patentee: Kasahara et al. Issued: Dec. 27, 1983

U.S. Pat.No. 4,591,261 Patentee: Saruwatari et al. Issued: May 27, 1986

U.S. Pat. No. 4,461,562 Patentee: Goldfinch Issued: July 24, 1984

The relevant portions of the foregoing disclosures may be briefly summarized as follows:

U.S. Pat. No. 3,709,713 discloses a developer roll having a magnet which indexes from a development position to a non-development position. A solenoid rotates the magnet to the respective positions.

U.S. Pat. No. 4,422,405 describes a multicolor copier with a single developer unit for use with three different toner applicator units. The developer unit and each applicator unit contain a rotatable hollow cylinder with magnets mounted fixedly within for attracting toner. As each applicator unit meets with the developer unit for toner transfer, the poles of magnets in both units are arranged radially opposite each other to form the toner into a desired magnetic brush.

U.S. Pat. No. 4,591,261 discloses a photocopier comprising a single photoconductive drum and two developing rollers for supplying developer material to the drum. A magnetic roll with a plurality of magnets is positioned with the rotatable cylindrical shell of each developing roller. Each magnetic roll is allowed to rock through 25° to predetermined positions by a roll/rocking mechanism. By doing so; the poles of of selected magnets are aligned and a magnetic brush is formed on the surface of only one developing roller.

U.S. Pat. No. 4,461,562 describes a rotatable rectangular core magnet within a cylindrical rotatable shell which transports toner to an electrostatic latent image. The core is rotatable through a 180° angle to a first and second position. In the first position, a magnetic brush of toner particles is applied to the latent image. In the second position, toner particles are drawn from a sump to the cylinder to form the magnetic brush.

Pursuant to the features of the present invention, there is provided an apparatus for developing a latent image with magnetic developer material. The apparatus includes means for transporting developer material closely adjacent to the latent image. Means, mounted movably, generate a magnetic flux field to attract developer material to the transporting means. The generating means is operatively associated with the transporting means to move under the influence of the magnetic flux field force exerted thereon. Means are provided for preventing movement of the generating means at selected positions. In a first position, developer material is closely adjacent to the latent image for development thereof. In a second position, developer material is spaced from the latent image to prevent development thereof.

In accordance with another aspect of the present invention, there is provided an apparatus for developing a latent image with magnetic developer material. The apparatus includes a rotating applicator roll, and a magnet. The magnet is mounted rotatably interiorly of the applicator roll and generates a magnetic flux field to attract the developer material to a portion of the surface of said applicator roll. The magnet is adapted to be rotated by the torque applied thereon by the magnetic flux field attracting the developer material to the surface of the rotating applicator roll. Means prevent rotation of the magnet to position the magnetic flux field at selected positions. In a first position, the developer material is transported into contact with the latent image for development thereof. In a second position, the developer material is spaced from the latent image to prevent development thereof.

In another aspect of the present invention, there is provided an electrophotographic printing machine of the type having magnetic developer material developing an electrostatic latent image recorded on a photoconductive member. Means are provided for transporting developer material closely adjacent to the photoconductive member. Means, mounted movably, generate a magnetic flux field to attract developer material to the transporting means. The generating means is operatively associated with the transporting means to move under the influence of the magnetic flux field force exerted thereon. Means prevent movement of the generating means at selected positions. In a first position, developer material is closely adjacent to the photoconductive member for development of the latent image, and, in a second position, developer material is spaced from the photoconductive member to prevent development of the latent image.

Still another aspect of the present invention provides for an electrophotographic printing machine of the type in which a first electrostatic latent image recorded on a photoconductive member is developed with magnetic developer material of one color, and a second electrostatic latent image recorded on the photoconductive member is developed with magnetic developer material of another color. The improvement includes a first developer unit for developing the first electrostatic latent image with the developer material of one color. The first developer unit comprises first transporting means for transporting the developer material of one color closely adjacent to the photoconductive member. First generating means, mounted movably, generates a magnetic flux field to attract the developer material of one color to the first transporting means. The first generating means is operatively associated with the first transporting means to move under the influence of the magnetic flux field force exerted thereon. First preventing means prevents movement of the first generating means at selected positions. In a first position, developer material is closely adjacent to the photoconductive member for development of the latent image, and, in a second position, developer material is spaced from the photoconductive member to prevent development of the latent image. A second developer unit, spaced from said first developer unit, develops the second electrostatic latent image with the developer material of the other color. The second developer unit comprises a second transporting means for transporting the developer material of the other color closely adjacent to the photoconductive member. Second generating means, mounted movably, generates a magnetic flux field to attract the developer material of the other color to the second transporting means. The second generating means is operatively associated with the second transporting means to move under the influence of the magnetic flux field force exerted thereon. Second preventing means prevents movement of the first generating means at selected positions. In a first position, developer material is closely adjacent to the photoconductive member for development of the latent image, and, in a second position, developer material is spaced from the photoconductive member to prevent development of the latent image. The first preventing means prevents movement of the first generating means in the first position when the second preventing means prevents movement of the second generating means in the second position. The first preventing means prevents movement of the first generating means, in the second position, when the second preventing means prevents movement of the second generating means in the first position.

Other aspects of the present invention will become apparent as the following description proceeds and upon reference to the drawings, in which.

Figure 1:
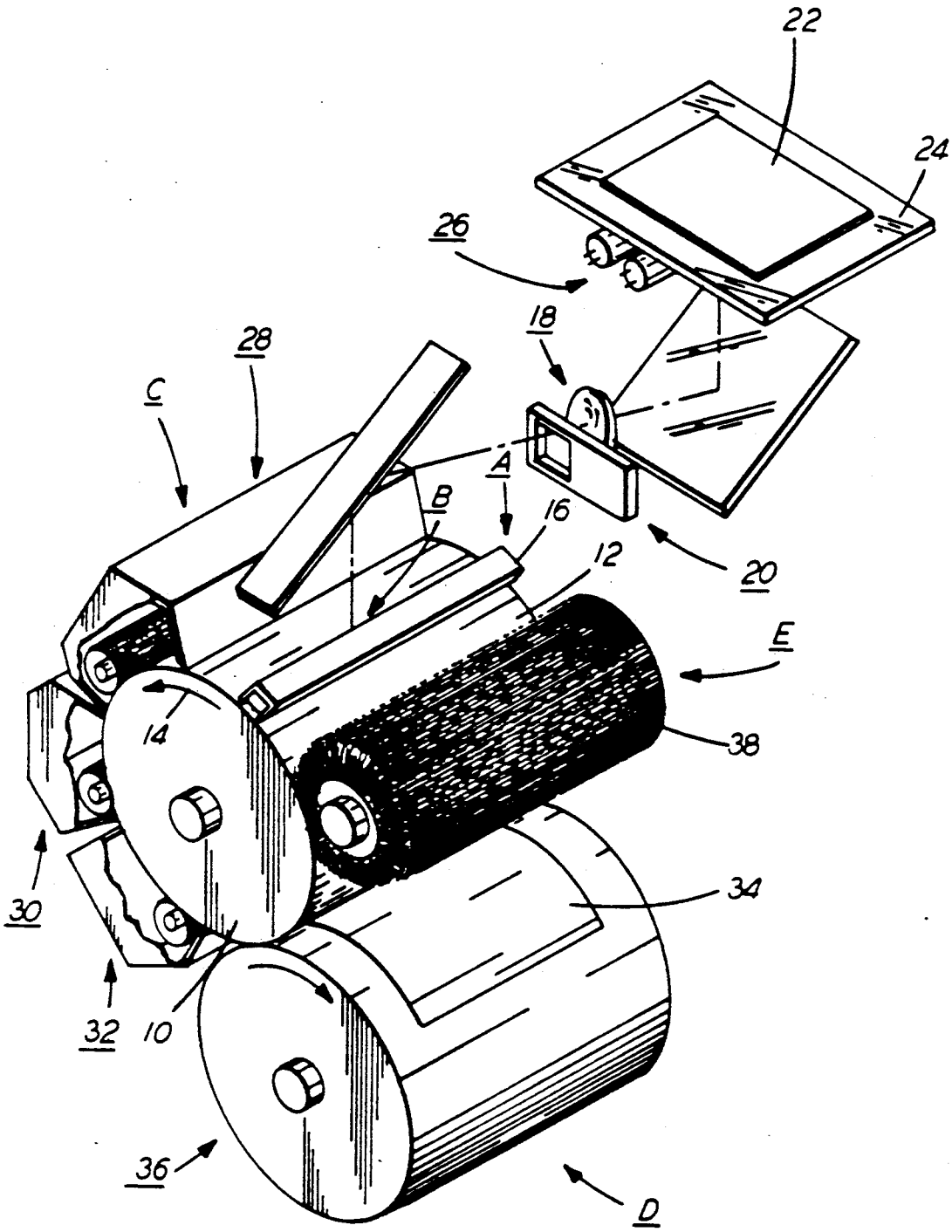
FIG. 1 is a schematic elevational view depicting an electrophotographic printing machine incorporating the development apparatus of the present invention therein.

For a general understanding of the features of the present invention, reference is made to the drawings. In the drawings, like references have been used throughout to designate identical elements. FIG. 1 schematically depicts the various components of an illustrative electrophotographic printing machine incorporating the development apparatus of the present invention therein. It will become evident from the following discussion that the development apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoconductive member such as rotatably mounted drum 10 having a photoconductive surface 12 thereon. Photoconductive surface 12, preferably, is formed from a selenium alloy having a relatively panchromatic response to white light. Drum 10 rotates in a direction indicated by arrow 14 to move photoconductive surface 12 sequentially through a series of processing stations. One skilled in the art will appreciate that while a photoconductive drum is being described herein as part of the illustrative electrophotographic printing machine, a photoconductive belt may be used in lieu thereof.

Initially, drum 10 rotates a portion of photoconductive surface 12 through charging station A. Charging station A has positioned thereat a corona generating device, indicated generally by the reference numeral 16, extending transversely across photoconductive surface 12. Corona generating device 16 charges photoconductive surface 12 to a relatively high, substantially uniform potential.

Next, the charged photoconductive surface is rotated to exposure station B. Exposure station B includes a moving lens system, generally designated by the reference numeral 18, and a color filter mechanism, shown generally by the reference numeral 20. An original document 22 is supported stationarily upon a transparent viewing platen 24. Successive incremental areas of the original document are illuminated by means of a moving lamp assembly, shown generally by the reference numeral 26. Lens system 18 is adapted to scan successive areas of illumination of platen 20 and to focus the light rays on photoconductive surface 12. Lamp assembly 26 and lens system 18 are moved in a timed relationship with respect to the movement of drum 10 to produce a flowing light image of the original document on photoconductive surface 12 in a non-distorted manner. During exposure, filter mechanism 20 interposes selected color filters into the optical light path of lens 18. The color filters operate on the light rays passing through the lens to record an electrostatic latent image on the photoconductive surface corresponding to a specific color of the flowing light image of the original document.

Subsequent to the recording of the electrostatic latent image on photoconductive surface 12, drum 10 rotates the electrostatic latent image to development station C. Development station C includes three individual developer units generally indicated by the reference numerals 28, 30 and 32. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional magnet flux field to form a brush of developer material. The developer particles are continually moving so as to provide the brush consistently with fresh developer material. Development is achieved by bringing the brush of developer material into contact with the photoconductive surface. Each of the development units 28, 30 and 32, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive surface 12, while the green light rays will pass through the filter and cause the charge density on the photoconductive surface 12 to be reduced to a voltage level ineffective for development. The charged areas are then made visible by applying green absorbing (magenta) toner particles onto the electrostatic latent image recorded on photoconductive surface 12. Similarly, a blue separation is developed with blue absorbing (yellow) toner particles, while the red separation is developed with red absorbing (cyan) toner particles. The detailed structure of one of the development units will be described hereinafter with reference to FIGS. 2 and 3.

After development, the now visible image is moved to transfer station D where the powder image is transferred to a sheet of final support material 34, such as plain paper amongst others, by means of a transfer member, i.e. a bias transfer roll indicated generally by the reference numeral 36. The surface of transfer roll 36 is electrically biased to a potential having a magnitude and polarity sufficient to electrostatically attract toner particles from photoconductive surface 12 to sheet 34. Transfer roll 36 is adapted to secure releasably thereto a single sheet of final support material 34 for movement in a recirculating path therewith. Transfer roll 36 is arranged to move in synchronism with drum 10 enabling sheet 34 to receive, in superimposed registration, successive toner powder images. The aforementioned steps of charging the photoconductive surface, exposing the photoconductive surface to a specific color of the flowing light image of the original document, developing the electrostatic latent image recorded on the photoconductive surface with appropriately colored toner particles, and transferring the toner powder images to a sheet of support material are repeated a plurality of cycles to form a multicolor copy of a color original document.

After the last transfer operation, sheet 34 is stripped from roll 36 and transported to a fusing station (not shown) where the transferred image is permanently fused to sheet 34. Thereafter, sheet 34 is advanced by endless belts (not shown) to a catch tray (not shown) for subsequent removal therefrom by the machine operator.

The last processing station in the direction of rotation of drum 10, as indicated by arrow 14 is cleaning station E. A rotatably mounted fibrous brush 38 is positioned in cleaning station E and maintained in contact with photoconductive surface 12 of rotating drum 10 to remove residual toner particles remaining after the transfer operation.

Figure 2:
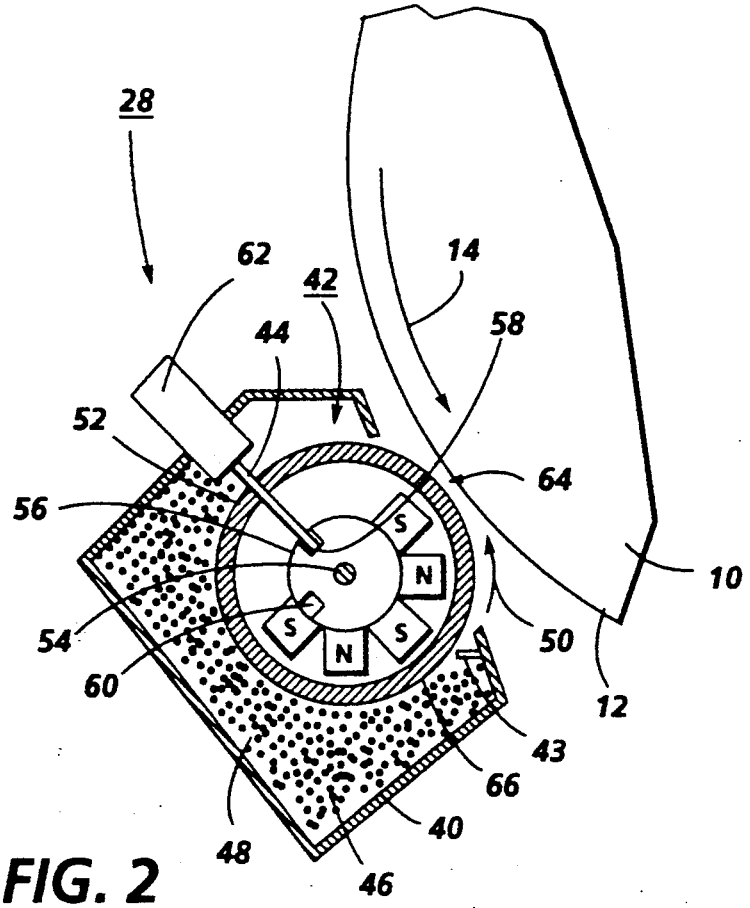
FIG. 2 is a schematic elevational view showing the development apparatus used in the FIG. 1 printing machine in the operative mode.

Referring now to FIG. 2, there is shown development unit 28. Only development unit 28 will be described in detail as development units 30 and 32 are substantially identical thereto, the distinction between each developer unit being the color of the toner particles contained therein and the minor geometrical differences due to their mounting position. Developer unit 28 may have yellow toner particles, unit 30 magenta toner particles, and unit 32 cyan toner particles although different color combinations may be used. For purposes of explanation, development unit 28 will hereinafter be described in detail.

The principle components of development unit 2, are a developer housing 40, a developer roller, indicated generally by the reference numeral 42, a solenoid actuated keeper bar 44, and a trim blade 43. Developer roller 42, solenoid actuated keeper bar 44 and trim blade 43 are all located in chamber 46 of housing 40. Developer material 48, which comprises magnetic carrier granules and yellow toner particles, is located in chamber 46 of housing 40. At least a portion of developer roller 42 is positioned in the developer material to developer roller 40. As developer roller 40 rotates in the direction of arrow 50, it attracts developer material to the surface thereof and transports the developer material in the direction of arrow 50. The trim blade regulates the quantity of developer material adhering to the surface of developer roller 42. In the preferred embodiment thereof, developer roller 42 includes a non-magnetic tubular member 52 preferably made from aluminum having an irregular or roughened exterior circumferential surface. Tubular member 52 is journaled for rotation by suitable means such as ball bearing mounts. A shaft 54, made preferably of a non-magnetic material, such as stainless steel, is concentrically mounted within tubular member 52 and serves as a mounting for magnetic member 56. Magnetic member 56, preferably, is made from barium ferrite or strontium ferrite having magnetic poles impressed about 180° of the circumferential surface thereof. The magnetic carrier granules having the toner particles adhering triboelectrically thereto is magnetically attracted to tubular member 52 over the portion thereof having the magnetic flux field. In the other regions, the developer material does not adhere to tubular member 52. A motor, not shown, rotates tubular member 52 in the direction of arrow 50. Magnet 56 generates a magnetic flux field to attract the developer material to the portion of the exterior surface of tubular member 52 opposed from the magnetic poles impressed thereon. As tubular member 52 rotates in the direction of arrow 50, the magnetic flux field attracting the developer material to the surface of tubular member 52 applies a torque on magnet 56 so as to rotate magnet 52 substantially in unison therewith in the direction of arrow 50. Magnet 56 extends beyond the end of tubular member 52 and has slots 58 and 60 therein located in the portion thereof extending beyond tubular member 52. Keeper bar 44 mates with slots 58 and 60. As shown in FIG. 2, solenoid 62 is energized to move keeper bar 44 toward magnet 56 so that the end thereof mates with slots 58. In that position, a magnetic flux field is generated in development zone 64 and about the right half 66 of tubular member 52. Keeper bar 44 prevents magnet 56 from rotating when it mates with slot 58. After development of the electrostatic latent image with yellow toner particles is completed, solenoid 62 is de-energized and keeper bar 44 is retracted out of slot 58, away from magnet 56, so as to be spaced from slot 58. Once magnet 56 is no longer restrained from rotating by keeper bar 44, it rotates 270°, in the direction of arrow 50, whereupon solenoid 62 is once again energized and keeper bar 44 mates with slot 60 preventing further rotation of magnet 56. This orientation is shown in FIG. 3.

Figure 3:
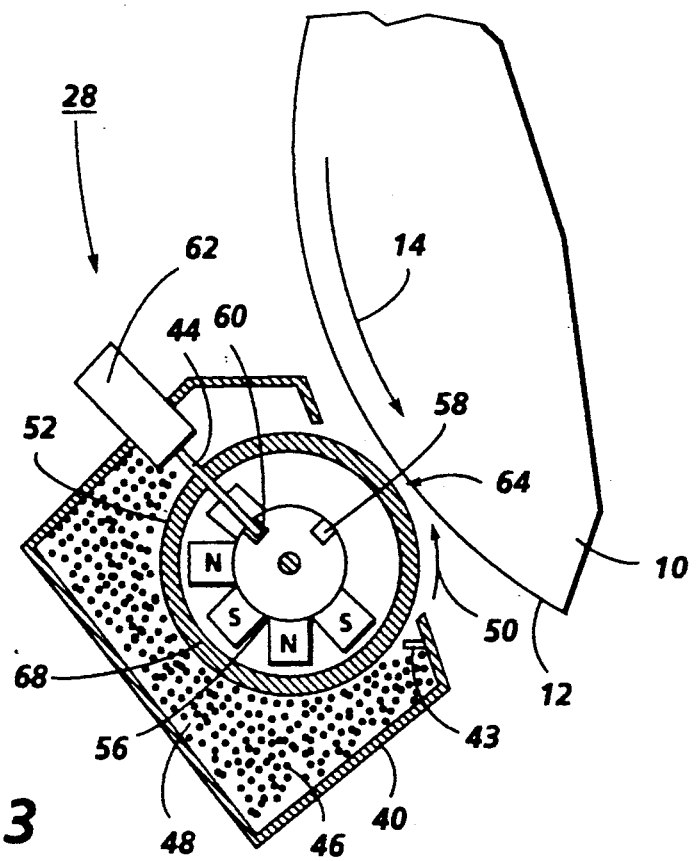
FIG. 3 is an elevational view depicting the development apparatus used in the FIG. 1 printing machine in the non-operative mode.

Turning now to FIG. 3, when keeper bar 44 mates with slot 60, development zone 64 is free of any magnetic flux field. Since there is no magnetic flux field in development zone 64, tubular member 52 does not advance the developer material into development zone 64 and development of the electrostatic latent images terminates. As shown, the magnetic poles of magnet 56 have rotated 270° to be positioned in the lower half 68 of tubular member 52. In this position, no magnetic field is generated in development zone 64 and development ceases. When it is necessary to develop the next electrostatic latent image with yellow toner particles, solenoid 62 is de-energized retracting keeper bar out of slot 60 permitting magnet 56 to rotate with tubular member 52 until slot 58 is once again aligned with keeper bar 44. At that time solenoid 62 is energized and keeper bar 44 once again mates with slot 58 preventing further rotation of magnet 56. In this orientation, a magnetic flux field is generated in development zone 64 and development is initiated, as shown in FIG. 2. Thus, in the operative mode, the magnetic is oriented so that there is a magnetic flux field in the development zone and the rotating tubular member advances the developer material into contact with the electrostatic latent image recorded on photoconductive surface 12 of drum 10. The toner particles are attracted from the carrier granules to the latent image forming a yellow toner powder image on drum 10. At this time, developer units 30 and 32 are inoperative, i.e. their respective magnets are oriented so that there is no magnetic flux field in the development zone. Alternatively, if one of the other developer units is in the operative mode, i.e. either developer unit 30 or developer unit 32, developer unit 28 must be in the inoperative mode. In the inoperative mode, the magnet is oriented so that there is no magnetic flux field in the development zone and the rotating tubular member does not advance developer material into the development zone preventing development of the electrostatic latent image. This prevents the electrostatic latent image recorded on photoconductive surface 12 of drum 10 from attracting developer material thereto. Thus, the electrostatic latent image remains devoid of toner particles. However, inasmuch as, at this time, either developer unit 30 or developer unit 32, is in the operative mode, the electrostatic latent image is subsequently developed with either magenta or cyan toner particles. In this manner, when the electrostatic latent image is formed with a blue filter, developer unit 28 is operative. At other times, developer unit 28 is inoperative. When the electrostatic latent image is formed with a red filter, developer units 28 and 30 are inoperative and developer unit 32 is operative. Finally, when the electrostatic latent image is formed with a green filter, developer unit 30 is operative and developer units 28 and 32 are inoperative. In this manner, successive electrostatic latent images are developed with differently colored toner particles. As previously indicated, the toner particles form toner powders image on photoconductive surface 12 of of drum 10 which are subsequently transferred to support material 34 (FIG. 1) in superimposed registration with one another to form the resultant multicolor toner powder image thereon.

In recapitulation, the development apparatus of the present invention employs a rotatably mounted magnet disposed interiorly of an applicator roller. A solenoid actuated keeper bar prevents the magnet from rotating with the applicator roll in at least two positions. In the operative mode, the keeper bar holds the magnet stationary with a magnetic flux field being generated in the development zone so that developer material is advanced into the development zone developing the electrostatic latent image. In contra distinction, in the non-operative mode, the keeper bar holds the magnet stationary in an orientation wherein the development zone is free of the magnetic flux field and no developer material is advanced into the development zone preventing development of the latent image.

It is, therefore, evident that there has been provided in accordance with the present invention, a development apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

We claim:

1. An apparatus for developing a latent image with magnetic developer material, including:

a rotating applicator roll;

a magnet, mounted rotatably interiorly of said applicator roll, for generating a magnetic flux field to attract the developer material to a portion of the surface of said applicator roll, said magnet being adapted to be rotated by the torque applied thereon by the magnetic flux field attracting the developer material to the surface of said rotating applicator roll; and means for preventing rotation of said magnet to position the magnetic flux field at selected positions so as to transport developer material into contact with the latent image in a first position for development thereof and to space the developer material from the latent image in a second position to prevent development thereof.

2. An apparatus according to claim 1, wherein said preventing means stops the rotation of said magnet in the first position so that the magnetic flux field attracts developer material to a portion of said applicator roll closely adjacent the latent image.

3. An appartus according to claim 1, wherein said preventing means stops the rotation of said magnet in the second position so that the magnetic flux field attracts developer material to a portion of said applicator roll spaced from the latent image with the portion of said applicator roll closely adjacent the latent image being substantially devoid of developer material.

4. An apparatus for developing a latent image with magnetic developer material, including:

a rotating applicator roll;

a magnet, mounted rotatably interiorly of said applicator roll, for generating a magnetic flux field to attract the developer material to a portion of the surface of said applicator roll, said magnet being adapted to be rotated by the torque applied thereon by the magnetic flux field attracting the developer material to the surface of said rotating applicator roll; and means for preventing rotation of said magnet to position the magnetic flux field at selected positions so as to transport developer material into contact with the latent image in a first position for development thereof and to space the developer material from the latent image in a second position to prevent development thereof, said magnet includes a first aperture and a second aperture, said second aperture being circumferentially spaced from said first aperture, said preventing means being adapted to mate with said first aperture or said second aperture to stop the rotation of said magnet in the first position or in the second position.

5. An apparatus according to claim 4, wherein said preventing means includes:

a solenoid; and a keeper bar coupled to said solenoid, said solenoid moving said keeper bar from a position spaced from said magnet, permitting rotation of said magnet, to a position mating with either said first aperture or said second aperture of said magnet, preventing rotation thereof, in the first position or the second position.

6. An electrophotographic printing machine of the type in which a first electrostatic latent image recorded on a photoconductive member is developed with magnetic developer material of one color and a second electrostatic latent image recorded on the photoconductive member is developed with magnetic developer material of another color, wherein the improvement includes:

a first developer unit for developing the first electrostatic latent image with the developer material of one color, said first developer unit comprising first transporting means for transporting the developer material of one color closely adjacent to the photoconductive memeber, first generating means, mounted movably, for generating a magnetic flux field to attract the developer material of the one color to said first transporting means, said first generating means being operatively associated with said first transporting means to move under the influence of the magnetic flux field force exerted thereon, and first preventing means for preventing movement of said first generating means at selected positions so that in a first position developer material is closely adjacent to the photoconductive member for development of the latent image and in a second position developer material is spaced from the photoconductive member to prevent development of the latent image; and a second developer unit, spaced from said first developer unit, for developing the second electrostatic latent image with the developer material of the other color, said second developer unit comprising second transporting means for transporting the developer material of the other color closely adjacent to the photoconductive member, second generating means, mounted movably, for generating a magnetic flux field to attract the developer material of the other color to said second transporting means, said second generating means being operatively associated with said second transporting means to move under the influence of the magnetic flux field force exerted thereon, and second preventing means for preventing movement of said second generating means at selected positions so that in a first position developer material is closely adjacent to the photoconductive member for development of the latent image and in a second position developer material is spaced from the photoconductive member to prevent development of the latent image, said first preventing means preventing the movement of said first generating means in the first position when said second preventing means prevents the movement of said second generating means in the second position and said first preventing means preventing the movement of said first generating means in the second position when said second preventing means prevents the movement of said second generating means in the first position.

7. A printing machine according to claim 6, wherein:

said first transporting means includes a first tubular member journaled for rotation;

said first generating means includes a first magnet mounted rotatably interiorly of said first tubular member for attracting developer material of the one color to said first tubular member;

said second transporting means includes a second tubular member journaled for rotation; and said second generating means includes a second magnet mounted rotatably interiorly of said second tubular member for attracting developer material of the other color to said second tubular member.

8. A printing machine according to claim 7, wherein:

said first preventing means stops the rotation of said first magnet in the first position so that the magnetic flux field attracts developer material of the one color to a portion of said first tubular member closely adjacent the photoconductive member; and said second preventing means stops the rotation of said second magnet in the second position so that the magnetic flux field attracts developer material of the other color to a portion of said second tubular member spaced from the photoconductive member.

9. A printing machine according to claim 7, wherein:

said first preventing means stops the rotation of said first magnet in the second position so that the magnetic flux field attracts developer material of the one color to a portion of said first tubular member spaced from the photoconductive member; and said second preventing means stops the rotation of said second magnet in the first position so that the magnetic flux field attracts developer material of the other color to a portion of said second tubular member closely adjacent to the photoconductive member.

10. An electrophotographic printing machine of the type in which a first electrostatic latent image recorded on a photoconductive member is developed with magnetic developer material of one color and a second electrostatic latent image recorded on the photoconductive member is developed with magnetic developer material of another color, wherein the improvement includes:

a first developer unit for developing the first electrostatic latent image with the developer material of the one color, said first developer unit comprising first transporting means for transporting the developer material of one color closely adjacent to the photoconductive member, said first transporting means comprises a first tubular member journalled for rotation, first generating means, mounted movably, for generating a magnetic flux field to attract the developer material of the one color to said first transporting means, said first generating means being operatively associated with said first transporting means to move under the influence of the magnetic flux field force exerted thereon, said first generating means includes a first magnet mounted rotatably interiorly of said first tubular member for attracting developer material of the one color to said first tubular member and first preventing means for preventing movement of said first generating means at selected positions so that in a first position developer material is closely adjacent to the photoconductive member for development of the latent image and in a second position developer material is spaced from the photoconductive member to prevent development of the latent image, said first magnet includes a first aperture and a second aperture, said second aperture being circumferentially spaced from said first aperture, said first preventing means being adapted to mate with said first aperture or said second aperture of said first magnet to stop the rotation of said first magnet in the first position or in the second position; and a second developer unit, spaced from said first developer unit, for developing the second electrostatic latent image with the developer material of the other color, said second developer unit comprising second transporting means for transporting the developer material of the other color closely adjacent to the photoconductive member, said second transporting means comprises a second tubular member journalled for rotation, second generating means, mounted movably, for generating a magnetic flux field to attract the developer material of the other color to said second transporting means, said second generating means includes a second magnet mounted rotatably interiorly of said second tubular member for attracting developer material of the other color to said second tubular member, said second generating means being operatively associated with said second transporting means to move under the influence of the magnetic flux field force exerted thereon, and second preventing means for preventing movement of said second generating means at selected positions so that in a first position developer material is closely adjacent to the photoconductive member for development of the latent image and in a second position developer material is spaced from the photoconductive member to prevent development of the latent image, said first preventing means preventing the movement of said first generating means in the first position when said second preventing means prevents the movement of said second generating means in the second position and said first preventing means preventing the movement of said first generating means in the second position when said second preventing means prevents the movement of said second generating means in the first position, said second magnet includes a first aperture and a second aperture, said second aperture being circumferentially spaced from said first aperture, said second preventing means being adapted to mate with said first aperture or said second aperture of said second magnet to stop the rotation of said second magnet in the first position or in the second position.

11. A printing machine according to claim 10, wherein said first preventing means includes:

a first solenoid; and a first keeper bar coupled to said first solenoid, said first solenoid moving said first keeper bar from a position spaced from said first magnet, permitting rotation of said first magnet, to a position mating with either said first aperture or said second aperture of said first magnet, preventing rotation thereof, in the first position or the second position.

12. A printing machine according to claim 10, wherein said second preventing means includes:

a second solenoid; and a second keeper bar coupled to said second solenoid, said second solenoid moving said second keeper bar from a position spaced from said second magnet, permitting rotation of said second magnet, to a position mating with either said first aperture or said second aperture of said second magnet, preventing rotation thereof, in the first position or the second position.

* * * * *